US008402876B2

(12) United States Patent
Cohen

(10) Patent No.: US 8,402,876 B2
(45) Date of Patent: Mar. 26, 2013

(54) BALLISTIC LIGHTWEIGHT CERAMIC ARMOR WITH CROSS-PELLETS

(75) Inventor: Hananya Cohen, New York, NY (US)

(73) Assignee: Edan Administration Services (Ireland) Limited, Dublin (IE)

( * ) Notice: Subject to any disclaimer, the term of this patent is extended or adjusted under 35 U.S.C. 154(b) by 117 days.

(21) Appl. No.: 13/094,851

(22) Filed: Apr. 27, 2011

(65) Prior Publication Data

US 2012/0090453 A1 Apr. 19, 2012
US 2012/0216668 A9 Aug. 30, 2012

Related U.S. Application Data

(63) Continuation-in-part of application No. 12/903,258, filed on Oct. 13, 2010.

(60) Provisional application No. 61/255,109, filed on Oct. 27, 2009.

(51) Int. Cl.
*F41H 5/02* (2006.01)

(52) U.S. Cl. ..... 89/36.02; 89/36.05

(58) Field of Classification Search ..... 89/36.02, 89/36.07, 903–909, 914; 109/49.5
See application file for complete search history.

(56) References Cited

U.S. PATENT DOCUMENTS

| | | | | |
|---|---|---|---|---|
| 4,061,815 | A | 12/1977 | Poole, Jr. | |
| 4,529,640 | A | 7/1985 | Brown et al. | |
| 4,836,084 | A | 6/1989 | Vogelesang et al. | |
| 4,868,040 | A | 9/1989 | Hallal et al. | |
| 5,705,764 | A | 1/1998 | Schade et al. | |
| 5,763,813 | A | 6/1998 | Cohen et al. | |
| 5,972,819 | A | 10/1999 | Cohen | |
| 6,112,635 | A | 9/2000 | Cohen | |
| 6,203,908 | B1 | 3/2001 | Cohen | |
| 6,289,781 | B1 | 9/2001 | Cohen | |
| 6,408,734 | B1 | 6/2002 | Cohen | |
| 8,291,808 | B2 | 10/2012 | Howland | |
| 2006/0243127 | A1 | 11/2006 | Cohen | |
| 2007/0137471 | A1 * | 6/2007 | Mazur | 89/36.02 |
| 2009/0078109 | A1 * | 3/2009 | Baxter et al. | 89/36.02 |
| 2012/0186434 | A1 | 7/2012 | Cohen | |

FOREIGN PATENT DOCUMENTS

| | | |
|---|---|---|
| EP | 1190647 | 3/2002 |
| GB | 1081464 | 8/1967 |
| GB | 1352418 | 5/1974 |
| GB | 2272272 | 5/1994 |
| WO | WO 94/24894 | 11/1994 |
| WO | WO 98/15796 | 4/1998 |
| WO | WO 02/41719 | 5/2002 |

OTHER PUBLICATIONS

International Search Report and the Written Opinion Dated Sep. 18, 2012 From the International Searching Authority Re.: Application No. PCT/IB2012/051697.

* cited by examiner

*Primary Examiner* — Stephen M Johnson
*Assistant Examiner* — John D Cooper

(57) ABSTRACT

An armor uses optimally shaped ceramic cross-pellets and a matrix for containing the cross-pellets. The armor comprises front and back plates and an array of interlocking ceramic cross-pellets of repeating shape between front and back plates. Each cross-pellet may have a horizontal cross-section in the shape of a cross and comprises a center and four fingers projecting therefrom. Each cross-pellet in a non-peripheral portion of the array may be supported by fingers of other cross-pellets which may include two fingers from each of four other cross-pellets. The result is lightweight, composite hybrid structure. The dense, hard armor has good fracture toughness, hardness and a high capacity to absorb impacts for ballistic protection particularly suited to tactical ground vehicles. Valley spaced is minimized. A polymer resin may be situated in spaces between the ceramic cross-pellets and between the array and at least one of the back plate and front plate.

29 Claims, 6 Drawing Sheets

FIG .1.
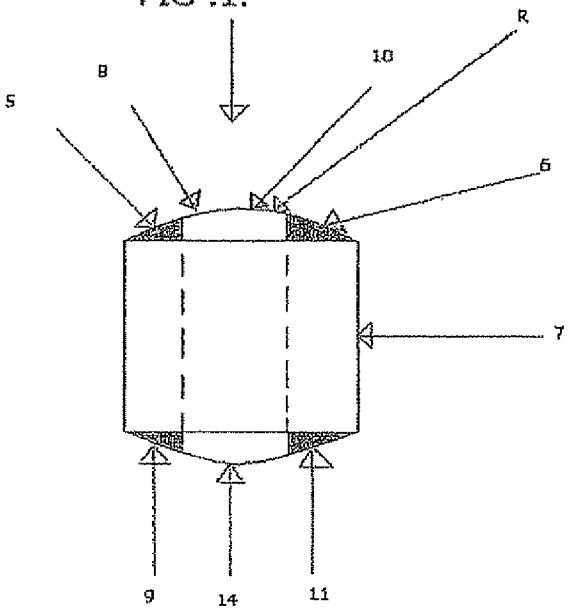
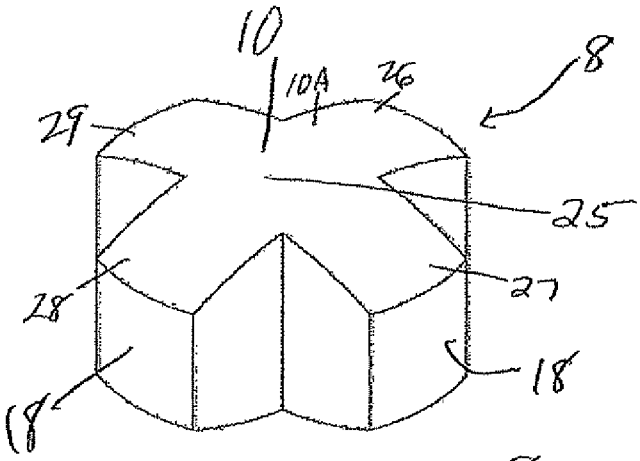
FIG. 1A
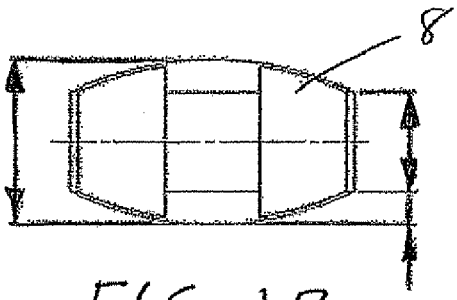
FIG. 1B

FIG. 2A (3D)

BALLISTIC LIGHTWEIGHT CERAMIC ARMOR WITH CROSS-PELLETS

RELATED APPLICATIONS

This patent application is a Continuation-in-Part (CIP) of U.S. patent application Ser. No. 12/903,258, filed Oct. 13, 2010 which claims the benefit of priority of U.S. Provisional Patent Application No. 61/255,109, filed Oct. 27, 2009.

FIELD AND BACKGROUND OF THE INVENTION

The present invention relates to apparatuses and methods for ballistic-impact armor structure and specifically precision formed container armor structure and methodology for making such structure and, more particularly to a lightweight and, more particularly to a lightweight ceramic-based integral armor made of cross-pellets and used for dissipating kinetic energy from ballistic projectiles, the armor having high fracture toughness.

During the last few decades, efforts have been made to produce ceramic-based armors which will be lower in mass than metals and thus be potentially more suitable for applications where weight is of significant importance, for example aircraft armor and armor for the human body. Some of these efforts have looked towards silicon carbide as a potential candidate for such applications whereas others have used fiber-reinforced ceramic materials.

Ballistic resistant armor is used in many applications including, for example, protection of vehicles and persons from ballistic threats. Body armor to be worn on a person for protection from, for example, ballistic threats, has been available for several decades. In general, body armor protects vital parts of the human torso against penetration and severe blunt trauma from ballistic projectiles. In the development of body armor, there is a continuing effort to develop lighter, stronger, thinner, and more durable armor.

Ballistic resistant armor is used in many applications including, for example, protection of vehicles and persons from ballistic threats. Body armor to be worn on a person for protection from, for example, ballistic threats, has been available for several decades. In general, body armor protects vital parts of the human torso against penetration and severe blunt trauma from ballistic projectiles. In the development of body armor, there is a continuing effort to develop lighter, stronger, thinner, and more durable armor.

Ceramic materials have long been considered for use in the fabrication of armor components because ceramic materials have a high hardness, are potentially capable of withstanding armor-piercing projectiles, and are relatively lightweight. However, the use of ceramic materials in armor applications has been limited by the low impact resistance of these materials, which results from ceramic's brittleness and lack of toughness. Indeed, one of the significant drawbacks to the use of ceramic materials in armor applications is that they lack repeat hit capability. In other words, ceramic materials tend to disintegrate upon the first hit and cease to be useful when subjected to multiple projectiles. For a more effective utilization of ceramic materials in armor applications, it is necessary to improve the impact resistance of this class of materials.

Desired minor protection levels can usually be obtained if weight is not a consideration. However, in many armor applications, there is a premium put on weight. Some areas of application where lightweight armor are important include ground combat and tactical vehicles, portable hardened shelters, helicopters, and various other aircraft used by the Army and the other Services. Another example of an armor application in need of reduced weight is personnel body armor worn by soldiers and law enforcement personnel.

State-of-the-art integral armor designs typically work by assembling arrays of ballistic grade ceramic tiles within an encasement of polymer composite plating. Such an armor system will erode and shatter projectiles, including armor-piercing projectiles, thus creating effective protection at reduced weight. Various designs are in current use over a range of applications. Substantial development efforts are ongoing with this type of armor, as it is known that its full capabilities are not being utilized. For example, there is a large body of information which shows that confining the ceramics results in an increase in penetration resistance.

The recent war in Iraq has heightened the need for ballistic armor. Military vehicles, in particular, are vulnerable to higher-potency weapons such as rocket-launched grenades and other projectiles. Military personnel want lightweight, fast and maneuverable vehicles, but they also want vehicle occupants to be fully protected. Ballistic steel armor plates, while relatively inexpensive, add thousands of pounds to a vehicle, many of which were not designed to carry such loads. This has resulted in numerous engine and transmission failures as well as problems with vehicle suspensions and brakes. The additional weight reduces fuel efficiency and makes it impossible to carry additional personnel in the vehicle in case of emergency. For these reasons, designers are beginning to adopt more lightweight composite armor across the board for military and tactical vehicles.

Multiple hits are a serious problem with ceramic-based armors. Armor-grade ceramics are extremely hard, brittle materials, and after one impact of sufficient energy, the previously monolithic ceramic will fracture extensively, leaving many smaller pieces and a reduced ability to protect against subsequent hits in the same vicinity. Further, when the impact is at sufficient energy and velocity, collateral damage typically occurs to the neighboring ceramic tiles. Schade, et al. (U.S. Pat. No. 5,705,764) uses a combination of polymers and polymer composites to encase the ceramic tiles in a soft surround to isolate the tiles from one another, reducing collateral damage.

Prior art armor or methods and apparatuses for such armor are described in U.S. Pat. Nos. 5,763,813; 5,972,819; 6,289,781; 6,112,635; 6,203,908; and 6,408,734 and in WO-A-9815796, U.S. Pat. Nos. 4,836,084, 4,868,040 and 4,529,640, British Patents 1,081,464; 1,352,418; 2,272,272, and in U.S. Pat. No. 4,061,815, the relevant teachings of which are incorporated herein by reference.

Examples of problems with existing composite materials and products made from the materials can include high weight, high cost of the materials, high manufacturing costs, and long manufacturing times. Additional examples of problems have included insufficient heat transfer resistance, poor acoustic properties, poor chemical resistance, poor moisture or water resistance, and inferior electrical properties. Existing composite materials have also been proven marginally cost effective for use as structural members or high strength materials. Desired material properties which have been insufficiently addressed by existing composite materials, include, for example, high strength to weight ratios, hot and cold insulation, high impact and compressive resistance, high flex modulus/stiffness, low specific gravity, chemical stability, sandability, formability, machineability, acoustics, reduced dielectric constant, non-combustible, water resistance, reduced warpage and shrinkage, and the ability to adhere or attach to other materials via conventional hardware or glues.

Furthermore, existing composite materials insufficiently combine various desired material properties together into a single material.

In the event cross-pellets bodies are distanced one from another to have them still retain their full ballistic resistance capabilities, in certain prior art armor it is known to add an "ear" or a pin-like protrusion to the ceramic body which acts to occupy the valley space and slow or erode the penetrating projectile or fragment. However, this adds to the complexity and cost of manufacture.

None of the prior art ceramic armors produced so far are entirely satisfactory, and the search has gone on for processes for producing more effective ceramic armors.

An incoming projectile may contact a pellet array in one of three ways: 1. Center contact. The impact allows the full volume of the pellet to participate in stopping the projectile, which cannot penetrate without pulverizing the whole pellet, an energy-intensive task. 2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy. 3. Valley contact. The projectile is jammed, usually between the flanks of three pellets, all of which participate in projectile arrest. The high side forces applied to the pellets is resisted by the pellets adjacent thereto as held by the substrate or plate, and penetration is prevented.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on composite materials, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

In response to ever-increasing anti-armor threats, improvements are warranted in the field of blast and fragment protection from explosive devices as well as ballistic mitigation.

There is a compelling need for better armor including armor made from improved materials, including lighter weight, lower cost, lower manufacturing costs, structural strength, and other properties.

SUMMARY OF THE PRESENT INVENTION

In one aspect of the present invention, there is provided a lightweight ballistic armor 10 having a high capacity to dissipate kinetic energy from high-velocity projectiles, comprising a front plate 20; an array of interlocking ceramic cross-pellets of repeating shape, each cross-pellet having a horizontal cross-section in the shape of a cross and comprising a center and four fingers projecting perpendicularly from the center, each cross-pellet in a non-peripheral portion of the array supported by eight fingers of four other cross-pellets including two fingers from each of the four other cross-pellets; and a back plate, the array disposed between the front and back plates.

A further aspect of the present invention is a lightweight ballistic armor layer having a high capacity to dissipate kinetic energy from high-velocity projectiles, comprising an array of interlocking ceramic cross-pellets of repeating shape, each cross-pellet having a horizontal cross-section in the shape of a cross and comprising a center and four fingers projecting from the center, each cross-pellet in a non-peripheral portion of the array supported by a multiplicity of fingers of four other cross-pellets, each cross-pellet having arcuate sides thereby defining valley space between adjacent cross-pellets, the valley space comprising no more than 5% of a volume of a cross-pellet.

In some preferred embodiments of the present invention a polymer resin is situated in spaces between the ceramic cross-pellets and between the array and at least one of the back plate and front plate. In other preferred embodiments a flexible support structure is disposed between the front and back plates for holding the array to the front and back plates. In some preferred embodiments, the armor includes fasteners for joining the front and back plates through the support structure, The front plate and back plate may be co-extensive.

In some preferred embodiments, an outer face of the center and four fingers of each cross-pellet is convex. In some preferred embodiments, the outer face is adjacent the front plate. In other preferred embodiments, sides of each of the four fingers of each cross-pellet are arcuate so that the center and four fingers define a cylindrical cross-pellet missing four arcuate corner segments. In some preferred embodiments, in non-peripheral portions of the array, for each cross-pellet, each finger adjoins fingers of two other cross-pellets. In some preferred embodiments the outer face of the center and four fingers of each cross-pellet is convex. In other preferred embodiments, sides of each of the four fingers of each cross-pellet are straight so that the center and four fingers define a rectangular cross-pellet missing four corner segments. In some preferred embodiments, open space between cross-pellets constitutes less than 1% of the volume of a cross-pellet. In other preferred embodiments, the array includes open space or valley space between cross-pellets that constitutes less than 5% or less than 10% or less than 15% or less than 25% of the volume of a cross-pellet. In still other preferred embodiments, the array includes open space between cross-pellets of less than 5% of the volume of a cross-pellet. In still other preferred embodiments, the open space comprises channels, thereby reducing the weight of the armor.

In some preferred embodiments the sides of the fingers which interlock with adjacent fingers of adjacent cross pellets have flat edges, thereby eliminating spaces between cross-pellets.

In some preferred embodiments, the ceramic cross-pellets are made from a composite of materials, the materials including at least two of alumina, boron carbide, boron nitride, silicon carbide, silicon nitride, and zirconium oxide.

In some preferred embodiments, for each cross-pellet, a diameter of the cross-pellet as measured from one end of a first finger to an opposite end of an oppositely situated finger exceeds a height of the cross-pellet.

In some preferred embodiments, the armor further comprises a shock absorbing layer disposed between the back plates the front plate includes a layer of ceramic cross-pellets embedded in a matrix. In some preferred embodiments, the front plate includes a layer of ceramic cross-pellets arranged in a close-packed matrix.

In still other preferred embodiments, a high tensile strength fabric is adhered to a back surface of the array of ceramic cross-pellets, the fabric comprising at least one of comprising woven carbon fabric, a layer of at least one of fiberglass, aramid fabric, metallic sheet, carbon or other fibers. In some embodiments the high-tensile strength fabric is made of polymeric threads selected from the group comprising aramid threads, polyester threads, synthetic threads, aramid fibers, ultra high resistance polyethylene fibers, thread fibers, and mixtures thereof.

In some preferred embodiments, the array of cross-pellets includes a layer of ceramic cross-pellets arranged in a hexagonal, close-packed matrix.

In other preferred embodiments, the front plate includes a layer of geometric interlocking ceramic cross-pellets each with a plurality of flat surfaces. In still other preferred embodiments, the back plate is itself a composite structure including opposing panels filled with a resin impregnated matrix of stuffers.

In still other preferred embodiments, the armor includes a plurality of attached front and back plates which together form a hinged sheet capable of being draped over a vehicle or other object to be protected.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein:

FIG. 1 is an elevational view of a cross-pellet used in the armor, in accordance with one embodiment of the present invention;

FIG. 1A is an isometric view of the cross-pellet of FIG. 1, in accordance with one embodiment of the present invention;

FIG. 1B is a side view of a cross-pellet, in accordance with one embodiment of the present invention;

FIG. 2A is a three-dimensional top view of the cylinder shown in FIG. 2, in accordance with one embodiment of the present invention;

DETAILED DESCRIPTION OF THE INVENTION

Figure 2:
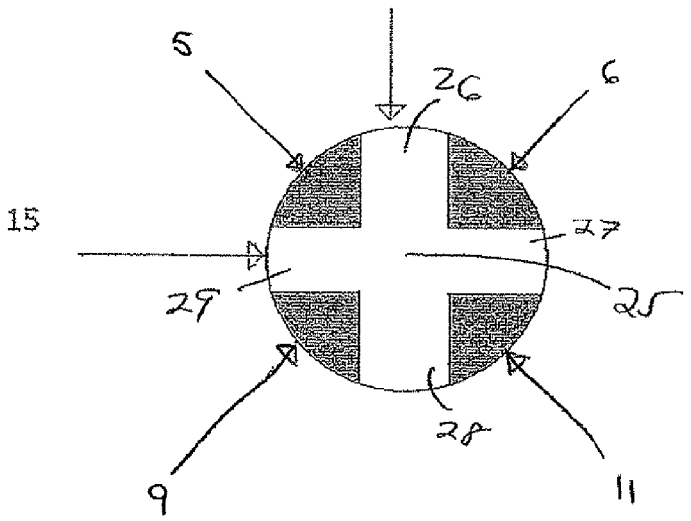
FIG. 2 is a top view of a cylinder from which is cut out a cross-pellet, in accordance with one embodiment of the present invention.
Figure 2:
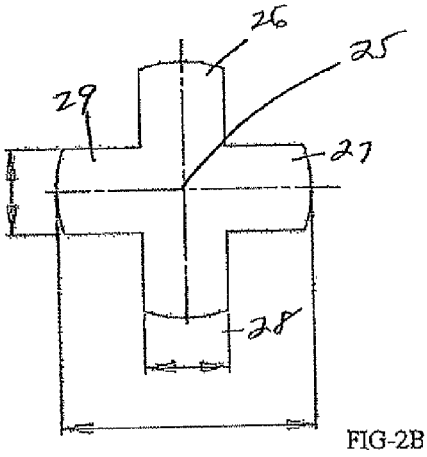
Figure 2B:
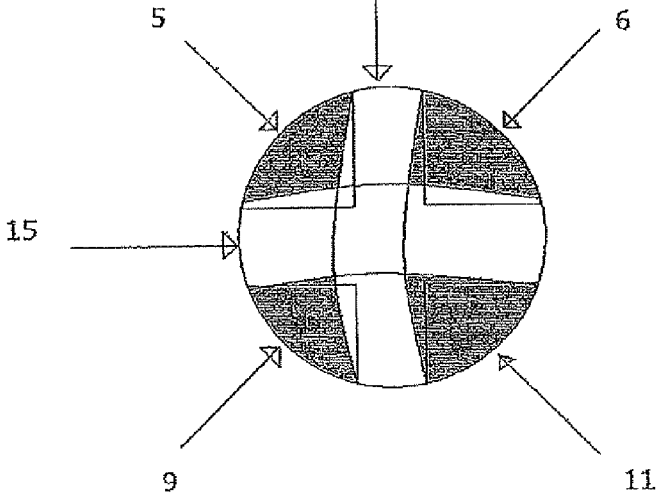
FIG. 2B is a top view of a cross-pellet, in accordance with one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The term "valley space" or "open space" between cross-pellets refers to such space that forms a part of a channel that goes through the entire thickness of the cross-pellet. Accordingly, mere valley indentations would not be included in the calculation of the volume of "open space" or valley space.

The term "elasticity" as used herein relates to the fact that the plates according to the present invention are bent when a load is applied thereto however upon release of said load the plate returns to its original shape without damage. Accordingly, the armor of the present invention may have high rebound hardness.

The present invention generally provides a ceramic body for deployment in a composite armor panel, for example for military and tactical vehicles, for absorbing and dissipating kinetic energy from projectiles and for ballistic armor panels incorporating the same and armored plates for providing ballistic protection for body armor, light and heavy mobile equipment and for vehicles against high-velocity, armor-piercing projectiles or fragments. The armor may comprise. a front plate, an array of interlocking ceramic cross-pellets of repeating shape, each cross-pellet having a horizontal cross-section in the shape of a cross and comprising a center and four fingers projecting perpendicularly from the center, each cross-pellet in a non-peripheral portion of the array supported by eight fingers of four other cross-pellets including two fingers from each of the four other cross-pellets. The array may be disposed between the front and a back plate. A polymer resin may be situated in spaces between the ceramic cross-pellets and between the array and at least one of the back plate and front plate. The valley space between the cross-pellets may be minimized to 1% or in other embodiments 5% or 10% or 15% yet the existence of some valley space in a preferred embodiment reduces weight, improves shock absorption by ensuring elasticity and flexibility and attenuates shock waves. The invention provides a composite armor plate for absorbing and dissipating kinetic energy from high-velocity projectiles, the plate comprising a single internal layer of cross pellets which are bound and retained in plate form the cross pellets. composite armor plate comprising: a single internal layer of cross pellets made of ceramic material disposed in a plurality of spaced-apart rows and columns, which are bound and retained in plate form by an elastic material; a majority of said cross pellets having at least one convexly curved end face; an outer impact receiving major surface defined by said convexly curved end faces of said cross pellets for absorbing and dissipating kinetic energy from high-velocity projectiles; said convexly curved end faces of said cross pellets receiving impact from high-velocity projectiles and absorbing and dissipating kinetic energy therefrom;

The present invention improves upon existing composite armor designs through the use of optimally shaped ceramic cross-pellets and a web system for patterning the cross-pellets, improving manufacturability, and providing additional structural reinforcement. The result is lightweight, composite hybrid structures for ballistic protection particularly suited to tactical ground vehicles and body armor.

The composite armor system of the present invention may have the following features: ultra-light-weight compared with existing armor structures; flexibility to fit various vehicle bodies and contours, superior impact energy absorption capability due to the unique design of the armor unit, superior strength for structural integrity due to the tendon-reinforcements, capability to resist heat and flame due to the flexibility to select desirable parent materials for the composite, ease of manufacture, maintenance and repair and low life-cycle cost due to the fact that armor units can be installed and removed individually, and applicability to other military applications and to commercial vehicle systems.

Basic armor configuration according to the invention is illustrated in. FIGS. 1-6 and shows construction of armor plate. The ceramic layer used in the front plate 30 may preferably be composed of a single- or multi-layered fabric network filled by thermoplastic polymer material and ceramic cross-pellets, which are arranged in a periodic pattern designed for improving the ballistic resistance, especially for multiple hits. The ceramic cross-pellets will have an optimally designed shape, which enhances the transferring of impact load onto surrounding cross-pellets. This feature results in desired compress stress among the cross-pellets, which reduces the crack propagation and improves the out-of-plane impact resistance performance.

The ceramic cross-pellet in the plate may be molded with the selected thermoplastic polymer material, which functions as impact absorber and position keeper of the cross-pellet. The fabric web in the ceramic cross-pellet has two major functions: one is to keep the cross-pellet in a desired arrangement and the other is to reinforce the ceramic cross-pellets during the ballistic impact.

The back plate 40 may feature ultra-light weight and outstanding out-of-plane stiffness, strength. It is designed to have improved bending stiffness and strength for optimizing the armor performance. The fabric web is designed to hold the armor in place and form an integrated armor kit that can fill into various vehicle contours. The optimally designed supporting structure also provides the advanced features for low cost and easiness to install, replace, and repair.

A composite armor plate opening (open space or valley space) may occupy a volume of up to 1% or up to 5% or 10% or 15% or up to 25% of said cross pellet and in one particular embodiment the valley space may be approximately 2.2 mm. A composite armor plate cross pellets may have at least one axis of at least 8 mm or may have at least one axis of at least 16 mm.

It has been discovered that when using pellets of increased diameter especially for light and heavy armored vehicles for dealing with large projectiles, the valley space between adjacent cylindrical pellets increases as the diameter of the pellets increase. While a prior art pellet of regular polygonal cross-section, such as a hexagon, reduces and almost eliminates said valley space, it has been found that the maintenance of a valley space between four adjacent cross-pellets of the present invention has several major advantages including assuring the elasticity and flexibility of the plate, reducing the overall weight of the plate and serving to attenuate the propagation of shock waves between adjacent plates.

The present invention may comprise a composite armor plate for absorbing and dissipating kinetic energy from high-velocity projectiles, said plate comprising a single internal layer of cross pellets which are bound and retained in plate form.

In contrast to the prior art, the armor formed with cross pellets according to the present invention may enable the use of cross pellets of large diameter with only a small valley space there between. Thus while the large size pellets of the prior art, for example that described in U.S. Pat. No. 6,112,635, are effective for stopping larger size projectiles, there is always a danger that a small caliber projectile or a projectile fragment could find its way into the valley gap between said large diameter pellets. The cross pellets of the present invention may result in a much smaller valley gap than that obtained with pellets having cylindrical cross-sections of comparable diameter. Furthermore, the cross pellets of the present invention may be formed by effectively cutting away arcuate segments of a cross pellet having formed from cylindrical body and which preferably has at least one convexly curved end face and then cutting away the corners of the polygon formed thereby to form a cross pellet. As a result, segments of the composite cross pellet may be lighter weight than the weight of the regular pellets. Accordingly, using cross-pellets of the present invention to form composite armor plates, one no longer has to worry that an increase in pellet size results in an accompanying increase in valley gap since the size of the valley gap can be controlled by creating straight cut around edge of the cross pellets or by decreasing the arch edge. In contrast to regular prior art pellets having three pellets where creating space between the three pellet yields a significant amount of space the cross-pellets valley space of the present invention is between four cross-pellets therefore the valley space is much smaller. In further contrast to prior art armor configured with three pellets, the present invention has an array of cross-pellets, each of which is surrounded by four other cross-pellets. In still further contrast to the prior art armor having pellets, in which the valley space is either too large thus creating a risk that a small caliber projectile or a projectile fragment could find its way into the valley gap between said large diameter pellets, the array of cross-pellets of the present invention may utilize minimal valley space. For example, the valley space may be less than 1% or less than 5% or less than 15% in some preferred embodiments. In further contrast to the prior art pellets of regular polygonal cross-section, such as hexagons, in which there may be no valley space at all, in which case the advantages of assuring the elasticity and flexibility of the armor plate, reducing the overall weight of the plate and attenuating the propagation of shock waves between adjacent plates may be surrendered, the array of cross-pellets of the present invention may have repeating interlocking cross-pellets yet maintain at least some valley space to obtain these advantages while at the same time minimizing the volume of valley space to avoid the disadvantage of risking penetration of a projectile or fragment passing through the valley space.

In further contrast to prior art ballistic armor, utilizing the cross pellets of the present invention according to this preferred embodiment allows a reduction in weight and height of the cross pellets equal to the difference in height between the cut and the uncut segments thereof since projectiles react to the entire height of a cross-pellet at their point of impact including the height of the convex end face. In yet still further contrast to prior art armor made of ceramic materials, which may be brittle, the increased hardness of the armor of the present invention may assist in flattening the nose portion of incoming projectiles, which increases the forces stopping the projectile. Although the brittleness of ceramics is not conducive for sustained defeating of projectiles, a damage zone forms due to this helps to distribute the impact force over a larger area. Another effect of brittleness of ceramic material is the formation of long cracks that usually expand from the point of impact due to bending. The long cracks and resulting small pieces of ceramic material are harmful for the defeat of projectiles, because not much constraint exist in-plane to keep the material in the damage zone and to contribute resistance forces. The armor of the present invention may be much less brittleness and much less likely to have the long cracks.

Prior art armor pellets may have considered carbides and borides as candidates for use in pellets for armor because of their general high strength, hardness, elastic modulus, sonic velocity and lightweight, but these prior art pellets suffer from the brittleness of these materials as used in a flat plate configuration. As a result, prior art armor using carbides and borides have fractured or fragmented upon ballistic impact, and it has been necessary to confine use of such materials for armor. In contrast to the prior art, the armor of the present invention, because in part due to its special interlocking configuration, is able to incorporate carbides and borides and enjoy their advantages without suffering from propensity to fracture from projectiles.

In one preferred embodiment, the shape of the cross pellets 8 of the present invention is of repeating straight sides and with convex end faces on top and on the bottom. In some preferred embodiments, the cross-pellets 8 have a special shape, such that if the projectiles can be designed to change the penetration angle of the bullet, the armor will be much more effective. Therefore, the bigger the angle change is, the better the armor performances will be. Arch and curved shapes cause oblique impacts often reorienting & fracturing impacting projectiles.

Figure 5:
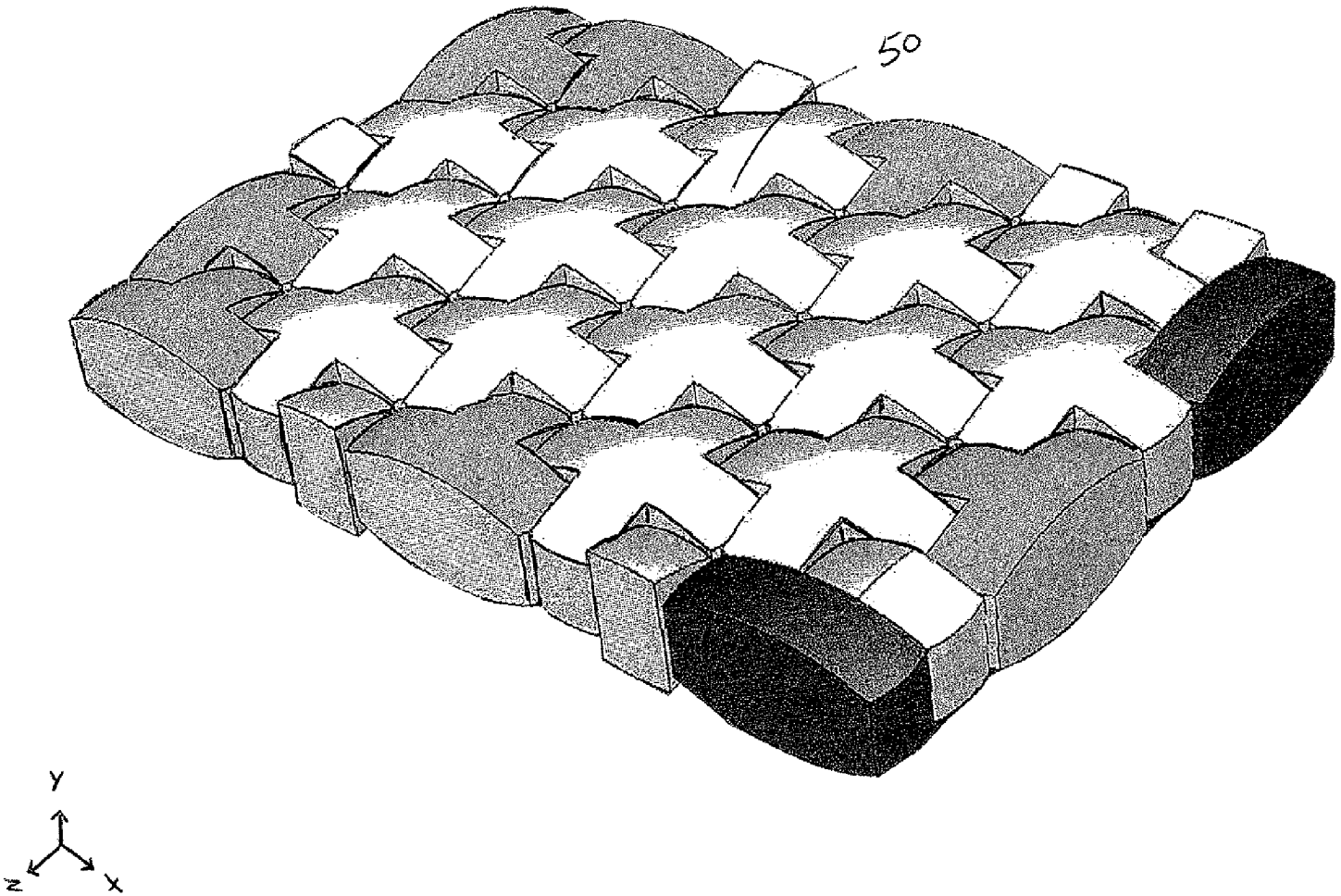
FIG. 5 is an array of cross-pellets, in accordance with one embodiment of the present invention.

In preferred embodiments, a majority of said cross pellets 8 have at least one convexly-curved end face 10 oriented to substantially face in the direction of an outer impact receiving major surface of said plate as shown in the array of cross pellets of FIG. 5.

Figure 6:
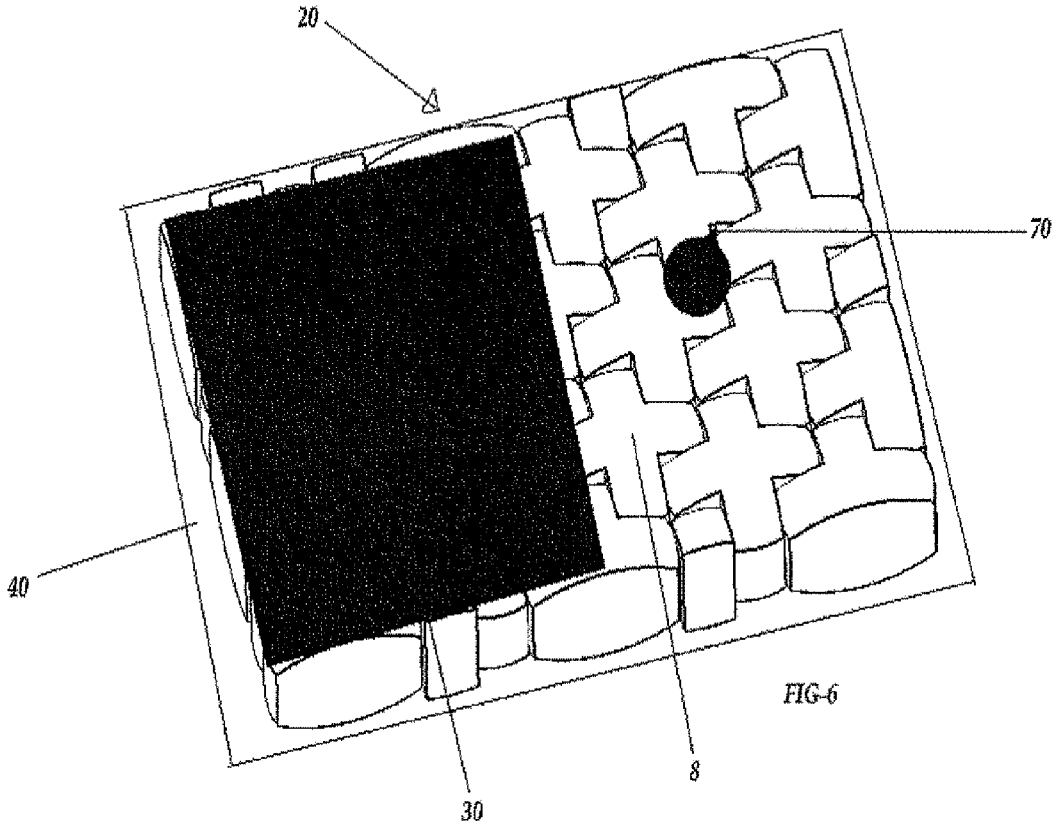
FIG. 6 is an armor with the front plate partly broken away to show the array of ceramic cross-pellets, in accordance with one embodiment of the present invention.

As seen from FIG. 6, armor 20 may comprise a front plate 30 (also called a top plate), and a back plate 40 (also called a backing plate) and an array 50 disposed between the front and back plates 30, 40. Front plate 30 and back plate 40 may be co-extensive. In some preferred embodiments, the array 50 of ceramic cross-pellets may be arranged in a hexagonical configuration. As seen in FIG. 5, an array 50 may be an array 50 of interlocking ceramic cross-pellets 8 of repeating shape. The cross-pellets may be closely packed together. In some preferred embodiments, armor 20 may include a plurality of attached front plates and a plurality of attached back plates which together form a hinged sheet capable of being draped over a vehicle or other object to be protected.

Figure 4:
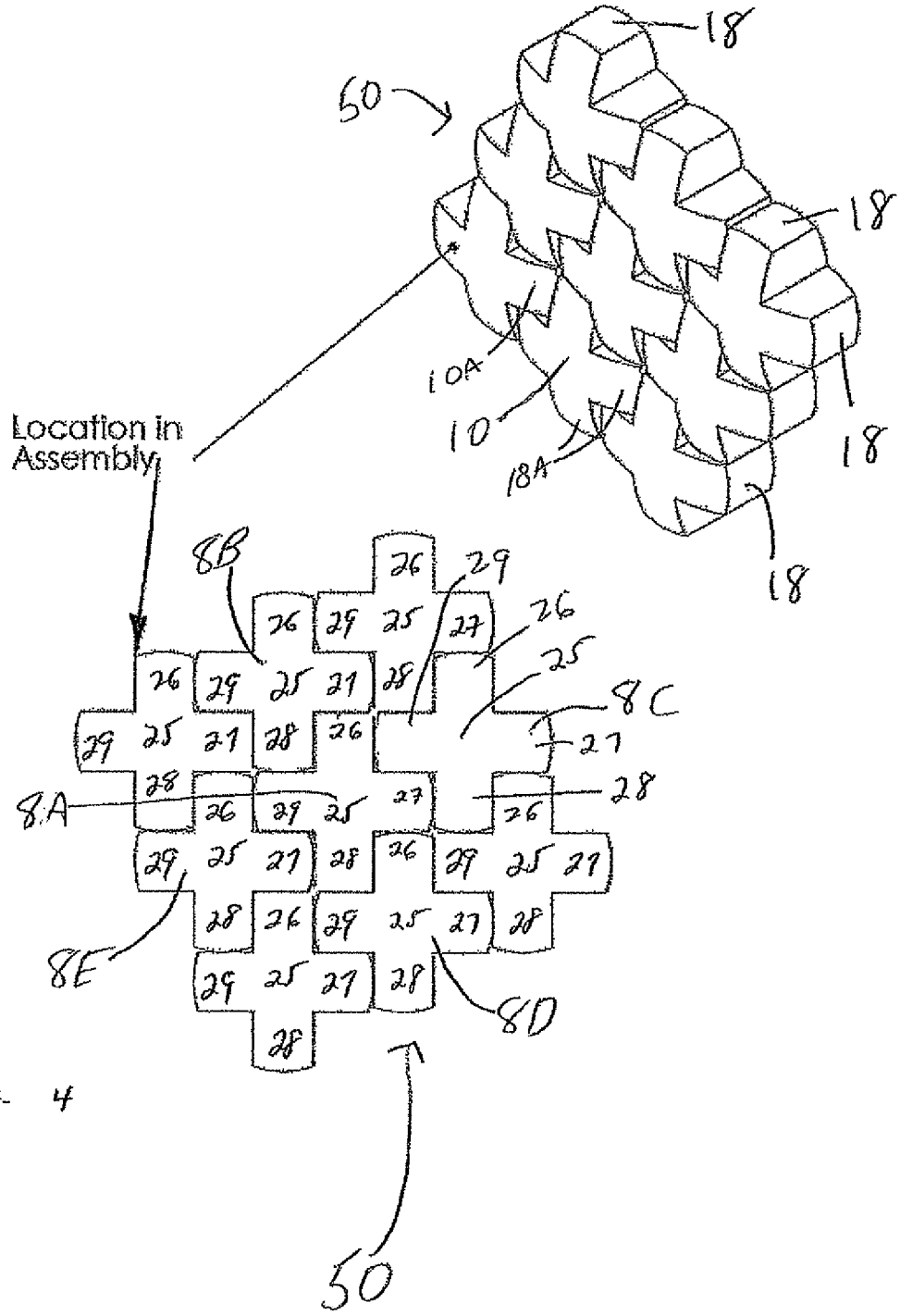
FIG. 4 is a top view and an isometric view of an array of arcuate cross-pellets, in accordance with one embodiment of the present invention.

Each cross-pellet 8 in array 50 may have a horizontal cross-section in the shape of a cross, as seen from FIG. 1A and FIG. 4. As seen in FIG. 1A, each cross-pellet 8 may comprise a center 25 and four fingers 26, 27, 28, 29 projecting perpendicularly from the center 25. As seen in FIG. 4, each cross-pellet 8, at least in the non-peripheral portion of the array 50, may be supported by fingers of four other cross-pellets. In one preferred embodiment shown in FIG. 4, two fingers from each of four other cross-pellets support each cross-pellet in the non-peripheral portion of the array 50. For example, as shown in FIG. 4, the cross-pellet 8A in the center of FIG. 8 is surrounded by four other cross-pellets 8B, 8C, 8D, 8E, each of which contribute two fingers to support the central cross-pellet 8A. In particular, in this example, cross-pellet 8B contributes fingers 27, 28; cross-pellet 8C contributes fingers 28, 29; cross-pellet 8D contributes fingers 26, 29 and cross-pellet 8E contributes fingers 26, 27. In non-peripheral portions of array 50. for each cross-pellet 8, each finger of the cross-pellet 8 may adjoin fingers of two other cross-pellets 8. Although FIG. 4 only shows nine cross-pellets, in an actual armor, it would be expected that array 50 may have many more cross-pellets 8 than that number. Accordingly, "non-peripheral portions" of array 50 would not refer to merely a single cross-pellet.

In FIG. 4 the arcuate sides of cross-pellets 8A-8E are such as to permit relatively small spaces or valleys between the cross-pellets. In the embodiment shown in FIG. 3, in contrast, there may be no open spaces between cross-pellets 8. In a preferred embodiment, and as shown in FIG. 4, the array 50 of cross-pellets may have open spaces between cross-pellets that are minimized. In preferred embodiments, the open spaces between cross-pellets 8 of array 50 may equal less than 1% of the volume of a cross-pellet. In other preferred embodiments, the open spaces between cross-pellets 8 in array 50 may constitute less than 5%, less than 15%, or less than 25% of the volume of a cross-pellet 8. The open space between cross-pellets may also be described as channels when viewed looking down at array 50 from above, i.e. above front plate 30. The open spaces reduce the weight of the armor.

As shown in FIG. 6, a polymer resin 70 may be situated in spaces between the ceramic cross-pellets and between the array and at least one of the back plate and front plate. The polymer resin 70 is an example of a flexible support structure that may be disposed between front plate 30 and back plate 40, which flexible support structure may hold the array 50 of interlocking cross-pellets 8 to the front and back plates 30, 40. The lightweight ballistic armor may also include, in certain preferred embodiments, fasteners, which may be rigid fasteners, and which may extend through polymer resin 70 so as to provide further support for holding the array of interlocking cross-pellets 8 to the front plate 30 and to the back plate 40. The polymer resin 70 may be considered a matrix and the array of cross-pellets may be considered a layer of ceramic cross-pellets embedded in a matrix.

The solid material used in back plate 40 and in front plate 30 may be made of any suitable material, such as aluminum, a thermoplastic polymer such as polycarbonate, or a thermoset plastic such as epoxy or polyurethane and in preferred embodiments of the present invention said solid material and said plate are elastic.

As shown in FIG. 1A, sides 18 of each of the four fingers 26, 27, 28, 29 of each cross-pellet 8 may be arcuate so that the center 25 and four fingers 26, 27, 28, 29 define a substantially cylindrical cross-pellet missing four arcuate corner segments.

As shown in FIG. 1, FIG. 1A, FIG. 2A, FIGS. 4-6, an outer face 10 of the center 25, also called "top outer face", of each cross-pellet 8 may be convex. Furthermore, as also seen in FIG. 1A, FIG. 2A, FIGS. 4-6, each of the four fingers 26, 27, 28, 29 of each cross-pellet 8 may also have a convex outer face 10A. Furthermore, in some embodiments, as shown in FIG. 1, bottom face 14 may also be convex. Outer face 10 may be situated adjacent front plate 30 and bottom face 14 may be situated adjacent back plate 40. Outer face 10 and bottom face 14 may also be referred to as curved end faces 10, 14.

The diameter of the cross-pellet 8 as measured from one end of a first finger 27 to an opposite end of an oppositely situated finger 29 may exceed a height of the cross-pellet 8. In some preferred embodiments, the height of the end face 14 disposed substantially opposite to an outer impact receiving end face of said cross-pellet may be less than the height of the impact receiving end face 10.

Cross-pellets 8, which may be being made of a ceramic material, may have a substantially regular geometric cross-sectional area, and first and second end faces 10, 14, each of said end faces 10, 14 projecting from said central body 25 and having an outwardly decreasing cross-sectional area. In one particular embodiment, the height of the end face 14 disposed substantially opposite to an outer impact receiving end face 10 of cross-pellet 10 may be less than 18% of the length of the diameter of the cross-pellet body from which it projects.

Figure 3:
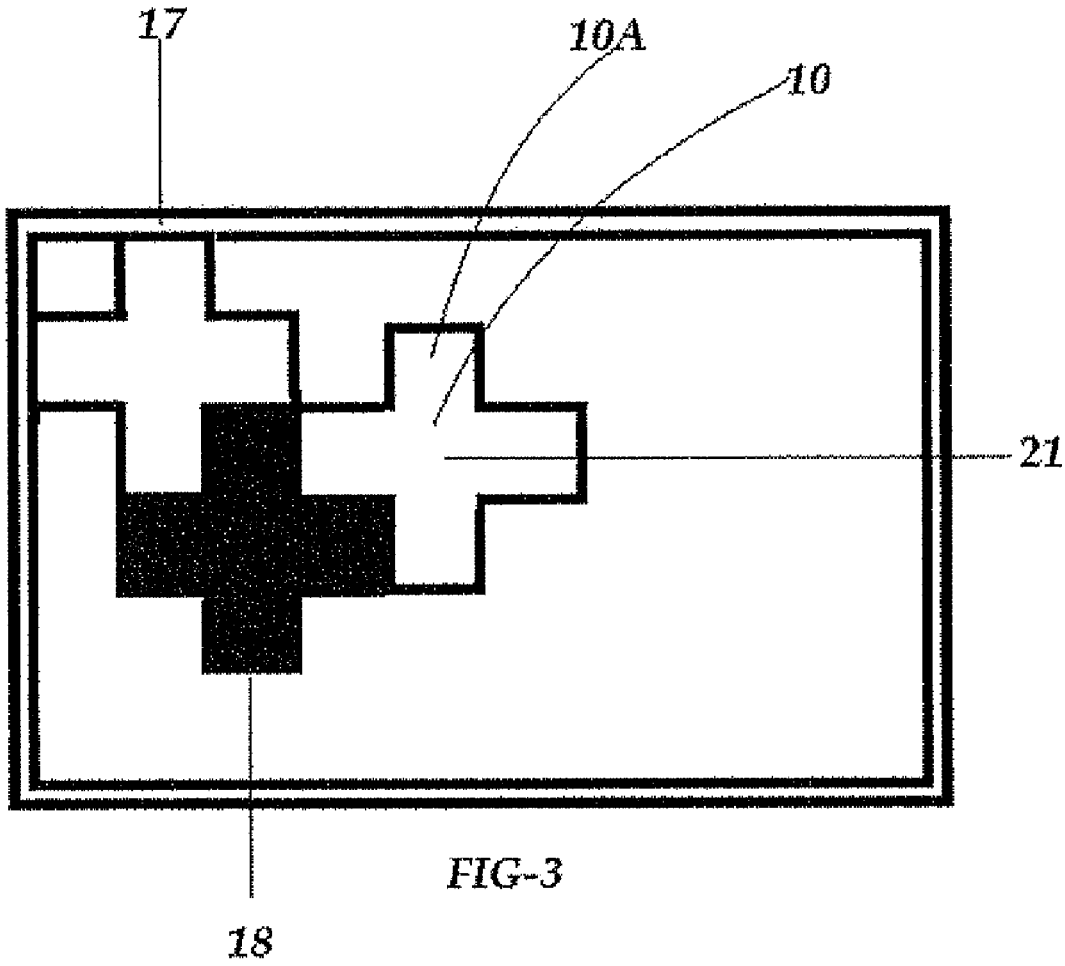
FIG. 3 is a partial array of cross-pellets having straight sides, in accordance with one embodiment of the present invention.

As shown. in FIG. 3, in other preferred embodiments, cross-pellet 8 may have a plurality of flat surfaces including outer face 10 of center 25 and outer face 10A of fingers 26, 27, 28, 29, as shown in FIG. 3, and including its sides 18. Bottom face 14 (not shown in FIG. 3 may in such embodiments also be flat. In such embodiment, the sides 18 of the cross-pellets may be flat, shown can be appreciated from FIG. 3. Accordingly, each of the sides of the four fingers of each cross-pellet that may interlock with adjacent fingers of adjacent cross-pellets may be straight (i.e. have flat edges) thereby eliminating space between cross-pellets 8. Accordingly, the center 25 and four finger 26, 27, 28, 29 may in this embodiment be said to define a rectangular cross-pellet that is missing four smaller corner segments. The array 50 in such cases may also be rectangular, as seen in FIG. 3.

FIG. 1 shows an elevational view of a preferred cross-pellet 8 according to the present invention having a substantially cylindrical body 7 and two convexly curved end faces 10 and 14. Body 7 is called substantially cylindrical although it is missing arcuate corner segments. As shown in FIG. 1, end face 10 which is designed to serve as the outer impact receiving end face of the cross-pellet 8, has a radius as indicated by the letter R. In the embodiment shown in FIG. 1, end face 14, which is designed to be disposed substantially opposite to the outer impact receiving end face 10, has a convex or spherical surface. In addition said cross-cross-pellet 8 is provided with channels 5, 6, 9, 11 which define substantially triangular shapes so as to increase the strength of the final armor plate 20 (FIG. 6).

FIG. 2 shows an elevational view of a further preferred cross-pellet 15 according to the present invention having channels 5, 6, 9, 11 in substantially triangle shapes to increase strength to the final armor plate. As seen in FIG. 2, cross-pellet 15 is provided with a channel 5, 6, 9, 11 as described in FIG.1. In addition said cross-pellet 15 is provided with a channel 5, 6, 9, 11 which will be assembled as showing in FIG.3. and FIG. 4, Increasing strength, toughness, hardness and a high capacity to absorb impacts for ballistic protection of the armor plate.

FIG. 4, depicts an elevational view of an array 50 of cross-pellets 8 used in an armor plate. The repeating pattern of cross-pellets 8 is similar to that shown in the other figures. except for FIG. 3.

The array of cross-pellets 8 may be made from a composite of materials. Such materials available for use in the array 50 of cross-pellets 8 of the present invention may include at least one of, and in some preferred embodiments at least two of, alumina, boron carbide, boron nitrate, silicon carbide, silicon nitride and zirconium oxide. In the composite armor plate each of the cross pellets 8 may be formed of a ceramic material selected from the group consisting of sintered oxide, nitrides, carbides and borides of alumina, magnesium, zirconium, tungsten, molybdenum, titanium and silica. In other preferred embodiment, each of said cross pellets may be formed of a material selected from the group consisting of alumina, boron carbide, boron nitride, titanium diboride, silicon carbide, silicon oxide, silicon nitride, magnesium oxide, silicon aluminum oxynitride and mixtures thereof.

In some preferred embodiments, a high tensile strength fabric may be adhered to a back surface of the array 50 of ceramic cross-pellets 8. The fabric may comprise at least one of woven carbon fabric, a layer of fiberglass, aramid fabric, carbon fibers, polymeric threads. The polymeric threads may be at least one of aramid threads, polyester threads, synthetic threads, aramid fibers, ultra high resistance polyethylene fibers, thread fibers and mixtures thereof. Alternatively, a metal sheet may be adhered to the back surface of array 50.

In some preferred embodiments, the back plate is itself formed of a composite of materials and includes opposing panels filled with a resin impregnated matrix of stuffers.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A lightweight ballistic armor having a high capacity to dissipate kinetic energy from high-velocity projectiles, comprising:

a front plate;

an array of interlocking ceramic cross-pellets of repeating shape, each cross-pellet having a horizontal cross-section in the shape of a cross and comprising a center and four fingers projecting perpendicularly from the center, each cross-pellet in a non-peripheral portion of the array supported by eight fingers of four other cross-pellets including two fingers from each of the four other cross-pellets; and a back plate, the array disposed between the front and back plates.

2. The armor of claim 1, further comprising a polymer resin situated in spaces between the ceramic cross-pellets and between the array and at least one of the back plate and front plate.

3. The armor of claim 1, further comprising a flexible support structure disposed between the front and back plates for holding the array to the front and back plates.

4. The armor of claim 3, further including fasteners for joining the front and back plates through the support structure.

5. The armor of claim 3, wherein sides of each of the four fingers of each cross-pellet are arcuate so that the center and four fingers define a cylindrical cross-pellet missing four arcuate corner segments.

6. The armor of claim 1, wherein an outer face of the center and four fingers of each cross-pellet is convex.

7. The armor of claim 6, wherein the outer face is adjacent the front plate.

8. The armor of claim 1, wherein in non-peripheral portions of the array, for each cross-pellet, each finger adjoins fingers of two other cross-pellets.

9. The armor of claim 1, wherein the outer face of the center and four fingers of each cross-pellet is convex.

10. The armor of claim 1, wherein sides of each of the four fingers of each cross-pellet are straight so that the center and four fingers define a rectangular cross-pellet missing four corner segments.

11. The armor of claim 10, wherein open space between cross-pellets constitutes less than 1% of the volume of a cross-pellet.

12. The armor of claim 1, wherein the array includes open space between cross-pellets that constitutes less than 25% of the volume of a cross-pellet.

13. The armor of claim 1, wherein the array includes open space between cross-pellets of less than 5% of the volume of a cross-pellet.

14. The armor of claim 1, wherein the cross-pellet shape is such that the sides of the fingers which interlock with adjacent fingers of adjacent cross pellets have flat edges, thereby eliminating spaces between cross-pellets.

15. The armor of claim 1, wherein the open space comprises channels, thereby reducing the weight of the armor.

16. The armor of claim 1, wherein the ceramic cross-pellets are made from a composite of materials, the materials including at least two of alumina, boron carbide, boron nitride, silicon carbide, silicon nitride, and zirconium oxide.

17. The armor of claim 1, wherein for each cross-pellet, a diameter of the cross-pellet as measured from one end of a first finger to an opposite end of an oppositely situated finger exceeds a height of the cross-pellet.

18. The armor of claim 1, further comprising a shock absorbing layer disposed between the back plates the front plate includes a layer of ceramic cross-pellets embedded in a matrix.

19. The armor of claim 1, wherein the front plate includes a layer of ceramic cross-pellets arranged in a close-packed matrix.

20. The armor of claim 1, further comprising a high tensile strength fabric adhered to a back surface of the array of ceramic cross-pellets, the fabric comprising at least one of comprising woven carbon fabric, a layer of at least one of fiberglass, aramid fabric, metallic sheet, carbon or other fibers.

21. The fabric of claim 20, wherein the high-tensile strength fabric is made of polymeric threads selected from the group comprising aramid threads, polyester threads, synthetic threads, aramid fibers, ultra high resistance polyethylene fibers, thread fibers, and mixtures thereof.

22. The armor of claim 1, wherein the back plate and front plates are co-extensive.

23. The armor of claim 1, wherein the array includes a layer of ceramic cross-pellets arranged in a hexagonal, close-packed matrix.

24. The armor of claim 1, wherein the front plate includes a layer of geometric interlocking ceramic cross-pellets each with a plurality of flat surfaces.

25. The armor of claim 1, wherein the back plate is formed of a composite of materials and includes opposing panels filled with a resin impregnated matrix of stuffers.

26. The armor of claim 1, wherein the armor includes a plurality of attached front and back plates which together form a hinged sheet capable of being draped over a vehicle or other object to be protected.

27. A lightweight ballistic armor layer having a high capacity to dissipate kinetic energy from high-velocity projectiles, comprising:

an array of interlocking ceramic cross-pellets of repeating shape, each cross-pellet having a horizontal cross-section in the shape of a cross and comprising a center and four fingers projecting from the center, each cross-pellet in a non-peripheral portion of the array supported by a multiplicity of fingers of four other cross-pellets, each cross-pellet having arcuate sides thereby defining valley space between adjacent cross-pellets, the valley space comprising less than 5% of a volume of a cross-pellet.

28. The lightweight ballistic armor layer of claim 27, wherein the valley space comprises less than 1% of the volume of the cross-pellet.

29. The lightweight ballistic armor layer of claim 27, wherein the each cross-pellet in the non-peripheral portion of the array is supported by two fingers from each of four other cross-pellets.

* * * * *